US005501084A

United States Patent [19]

Chang et al.

[11] Patent Number: 5,501,084

[45] Date of Patent: Mar. 26, 1996

[54] AIR STERILIZER AND DEODORIZER FOR A REFRIGERATOR

[75] Inventors: Eui-Young Chang; Sung-Cheol Kang; Jin-Dong Jeong; Tae K. Seok, all of Suwon, Rep. of Korea

[73] Assignee: Samsung Electronics Co., Ltd., Kyungki-do, Rep. of Korea

[21] Appl. No.: 330,723

[22] Filed: Oct. 28, 1994

[30] Foreign Application Priority Data

Nov. 24, 1993 [KR] Rep. of Korea ..... 93-24833

[51] Int. Cl.[6] ..... F25D 27/00

[52] U.S. Cl. ..... 62/264; 62/78; 62/443

[58] Field of Search ..... 62/78, 264, 443; 422/121, 122

[56] References Cited

U.S. PATENT DOCUMENTS

| | | | |
|---|---|---|---|
| 4,904,289 | 2/1990 | Miyakami et al. | 62/78 X |
| 4,948,567 | 8/1990 | Atarashiya | 62/78 X |
| 5,230,220 | 7/1993 | Kang et al. | 62/78 |
| 5,347,820 | 9/1994 | In Gweon | 62/78 |

FOREIGN PATENT DOCUMENTS

| | | | |
|---|---|---|---|
| 1-300184 | 12/1989 | Japan . | |
| 2-233978 | 9/1990 | Japan | 62/78 |
| 6-3038 | 1/1994 | Japan | 62/78 |

*Primary Examiner*—William E. Tapolcai
*Attorney, Agent, or Firm*—Burns, Doane, Swecker & Mathis

[57] ABSTRACT

A refrigerator includes a freezing chamber and a refrigerating chamber located beneath the freezing chamber and separated therefrom by a partition. An evaporator is disposed in the partition for cooling air received from the freezing and refrigerating chambers. A fan circulates that air to the evaporator and then back to the chambers. An air passage disposed in the partition communicates the refrigerating chamber with the evaporator. An air sterilizing and deodorizing mechanism is disposed at an upstream end of that passage for treating air leaving the refrigerating chamber and entering the passage.

8 Claims, 6 Drawing Sheets

AIR STERILIZER AND DEODORIZER FOR A REFRIGERATOR

FIELD OF THE INVENTION

The present invention relates to a refrigerator in which a sterilizing and deodoring means is installed for disinfecting the floating bacteria and for removing the foul odor which causes the freshness of the foods within the refrigerator to deteriorate.

BACKGROUND OF THE INVENTION

Generally, refrigerators in which a sterilizing and deodoring means is installed for sterilizing floating bacteria and for removing foul odor have been proposed.

One of the examples is the refrigerator which is disclosed in Japanese Patent Laid-open No. Heisei-1-300184 dated Dec. 4, 1989, the application being filed on May 26, 1985 by Mitsubishi Denki Co. , Ltd. of Japan.

This refrigerator of Japanese Patent Laid-open No. Heisei-1-300184 is illustrated in FIGS. 1 and 2. In this refrigerator, a duct cover 10' forms a duct 15', and the refrigerator further includes: an ozone generator 4' installed within the duct 15' so as for ozone to be introduced into the duct 15'; a high voltage generator 5' installed within the duct 15' for supplying a high voltage to the ozone generator 4'; a reaction chamber 6' for decomposing the particles of the foul odor by reacting the foul odor reacted with the ozone which is generated by the ozone generator 4' upon receiving the high voltage from the high voltage generator 5'; and an ozone decomposing device 7' installed between the reaction chamber 6' and a discharge hole **10*a'* of the duct 15'** for decomposing the remaining ozone.

In this conventional refrigerator, the ozone generator 4' and other devices are installed within the duct 15', and a separate fan and a fan motor for the deodorizer are not required, with the result that the manufacturing cost can be saved, and that a wide space within the refrigerator can be utilized. However, the cold air which has passed around an evaporator is supplied to the ozone generator 4', so that the foul odor cannot be effectively removed, so that the undecomposed ozone would be supplied into the refrigerator.

That is, in the conventional refrigerator, the cold air from the evaporator (about −20 degrees C) is directly supplied into the reaction chamber 6', and therefore, frost adheres on the surfaces of the ozone generator 4' and the ozone decomposing device 7'.

Consequently, the production rate of the ozone from the ozone generator 4' is decreased, with the result that the foul odor cannot be effectively removed, and that the ozone decomposing device 7' cannot decompose the ozone in an efficient manner, thereby supplying the ozone into the refrigerator.

That is, in the conventional refrigerator, the cold air which has passed around the evaporator is directly supplied into the ozone generator, with the result that the foul odor cannot be effectively removed. Further, the undecomposed ozone is supplied into the refrigerator, so that the freshness of food would be deteriorate.

SUMMARY OF THE INVENTION

The present invention is intended to overcome the above described disadvantages of the conventional technique.

Therefore, it is an object of the present invention to provide a refrigerator in which the cold air circulating inside the refrigerator is supplied into a sterilizing and deodoring means without the need for a separate fan and a fan motor, and then, is supplied into the refrigerator, so that the floating bacteria can be effectively sterilized, and the foul odor can be effectively removed. The lack of an extra fan and a fan motor results in a decrease in the heat production within the refrigerator for improving the refrigerating efficiency, as well as avoiding the production of extra noise and vibrations by such an extra a fan and fan motor, thereby improving the quality of the refrigerator.

In achieving the above object, the refrigerator according to the present invention includes: a main body forming a freezing room and a refrigerating room; a fan installed in the main body for circulating air; and an evaporator for chilling the circulating air. The refrigerator further includes: a sterilizing and deodoring means installed within the main body for sterilizing a floating bacteria and for removing foul odor; an outer contour member fixed to the top of the refrigerating room for guiding the purified cool air (purified by being sterilized and deodored) and for forming the outer contour of the refrigerating room; and a lower insulating member disposed on the upper face of the outer contour member for forming a cool air path.

In the refrigerator according to the present invention, the cool air after being circulated through the refrigerator passes through the sterilizing and deodoring means to be supplied to the evaporator, and therefore, frost is not formed on the inside of the sterilizing and deodoring means, with the result that the floating bacteria can be effectively sterilized, and the foul odor can be effectively removed.

BRIEF DESCRIPTION OF THE DRAWINGS

The above object and other advantages of the present invention will become more apparent by describing in detail the preferred embodiment of the present invention with reference to the attached drawings in which.

DESCRIPTION OF THE PREFERRED EMBODIMENT

Figure 1:
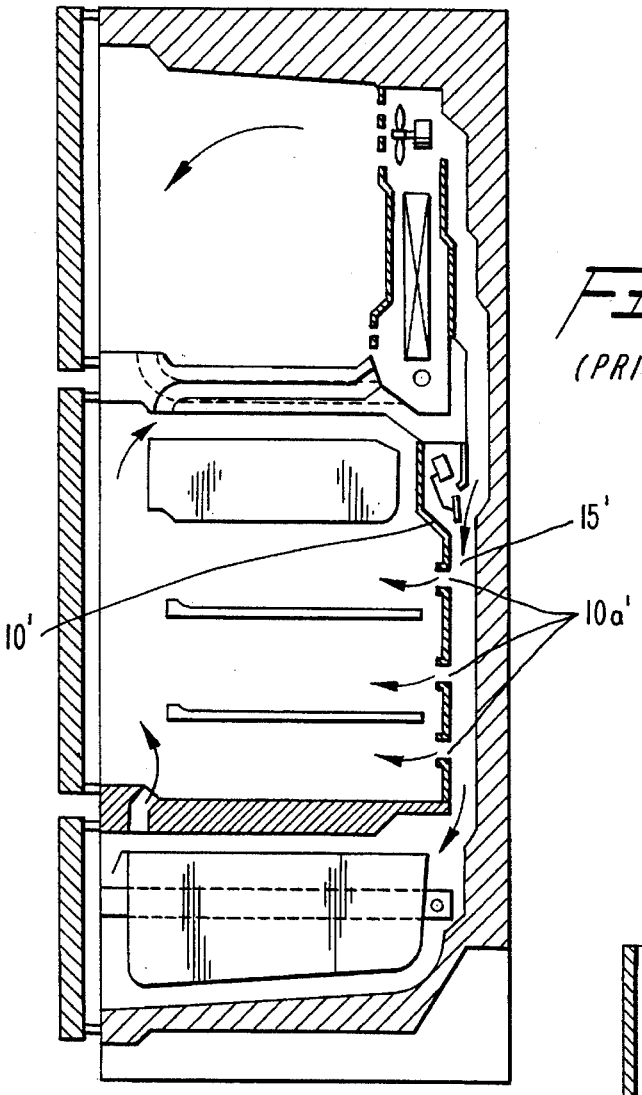
Fig. 1 (PRIOR ART)
FIG. 1 is a vertical sectional view which illustrates the internal structure of a conventional refrigerator.
Figure 2:
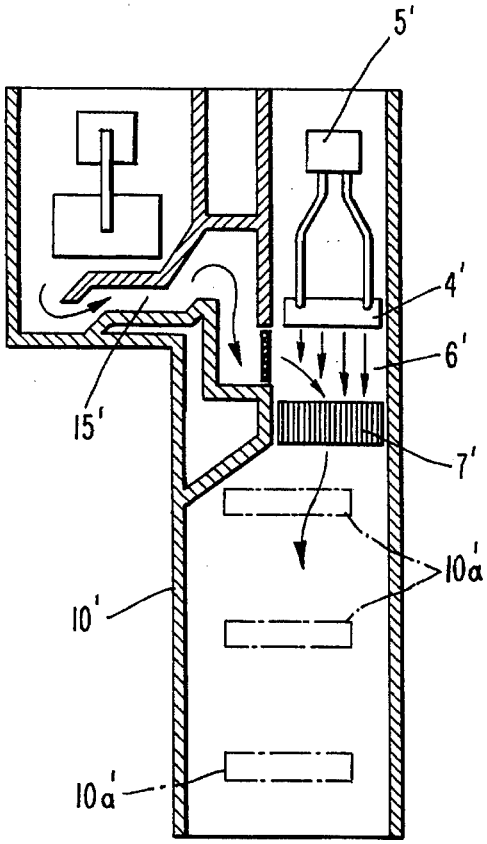
Fig. 2 (PRIOR ART)
FIG. 2 is a sectional view showing the internal structure of the deodoring device installed on the conventional refrigerator of FIG. 1.
Figure 3:
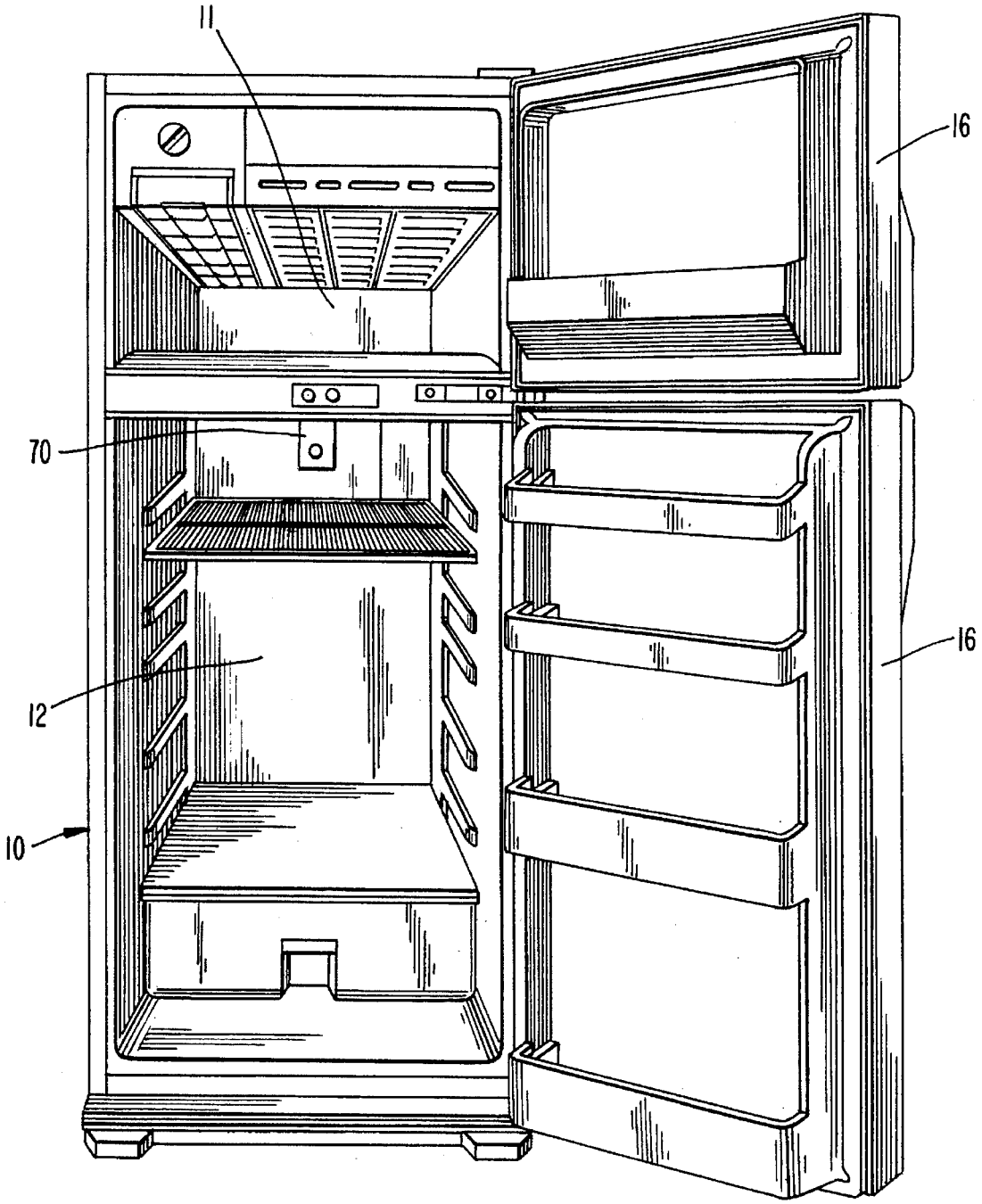
FIG. 3 is a perspective view showing a refrigerator with the door open, and with a sterilizing and deodoring means of a first embodiment of the present invention installed thereon.
Figure 4:
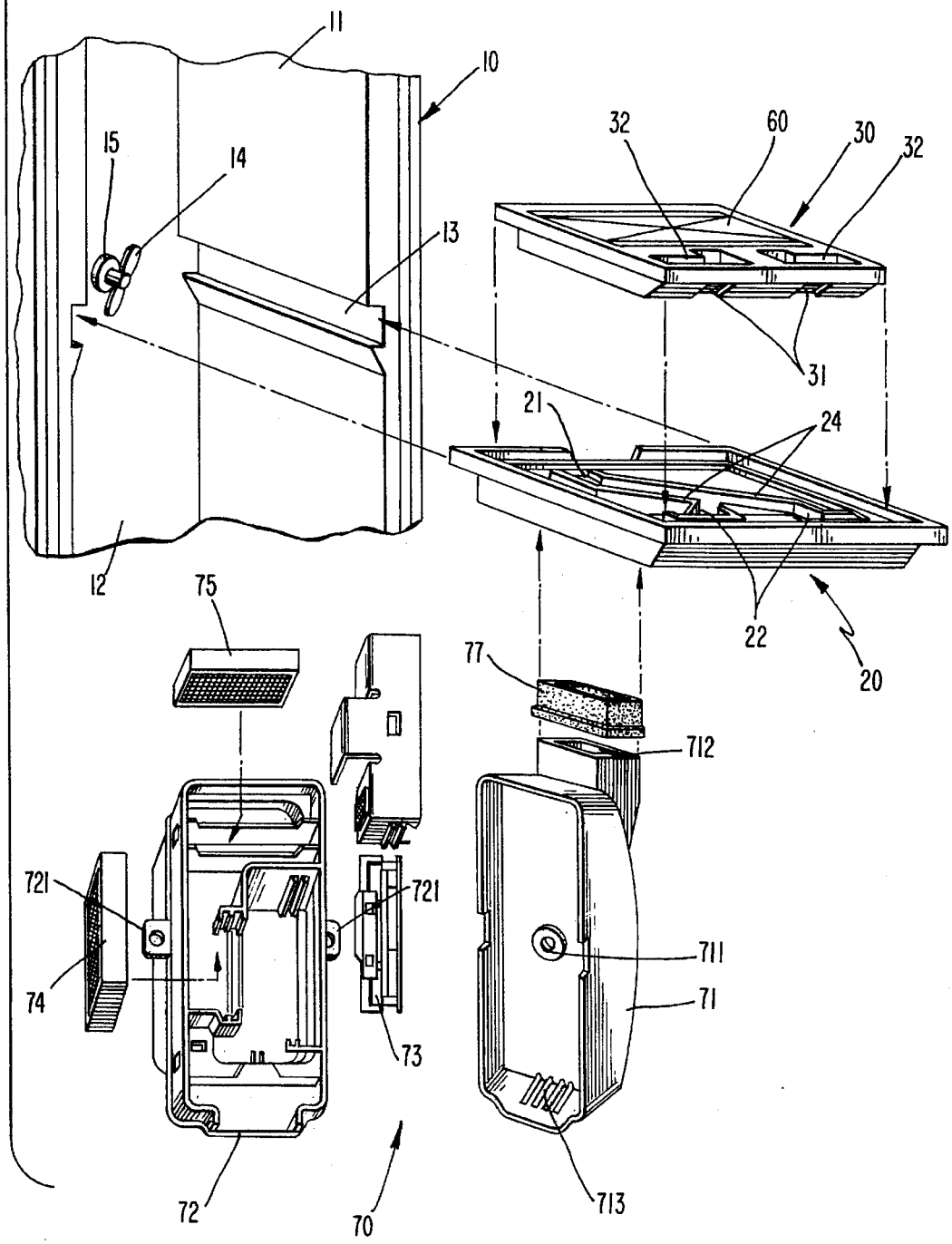
FIG. 4 is an exploded perspective view showing the principal components of the first embodiment of the sterilizing and deoderizer of the present invention.
Figure 5:
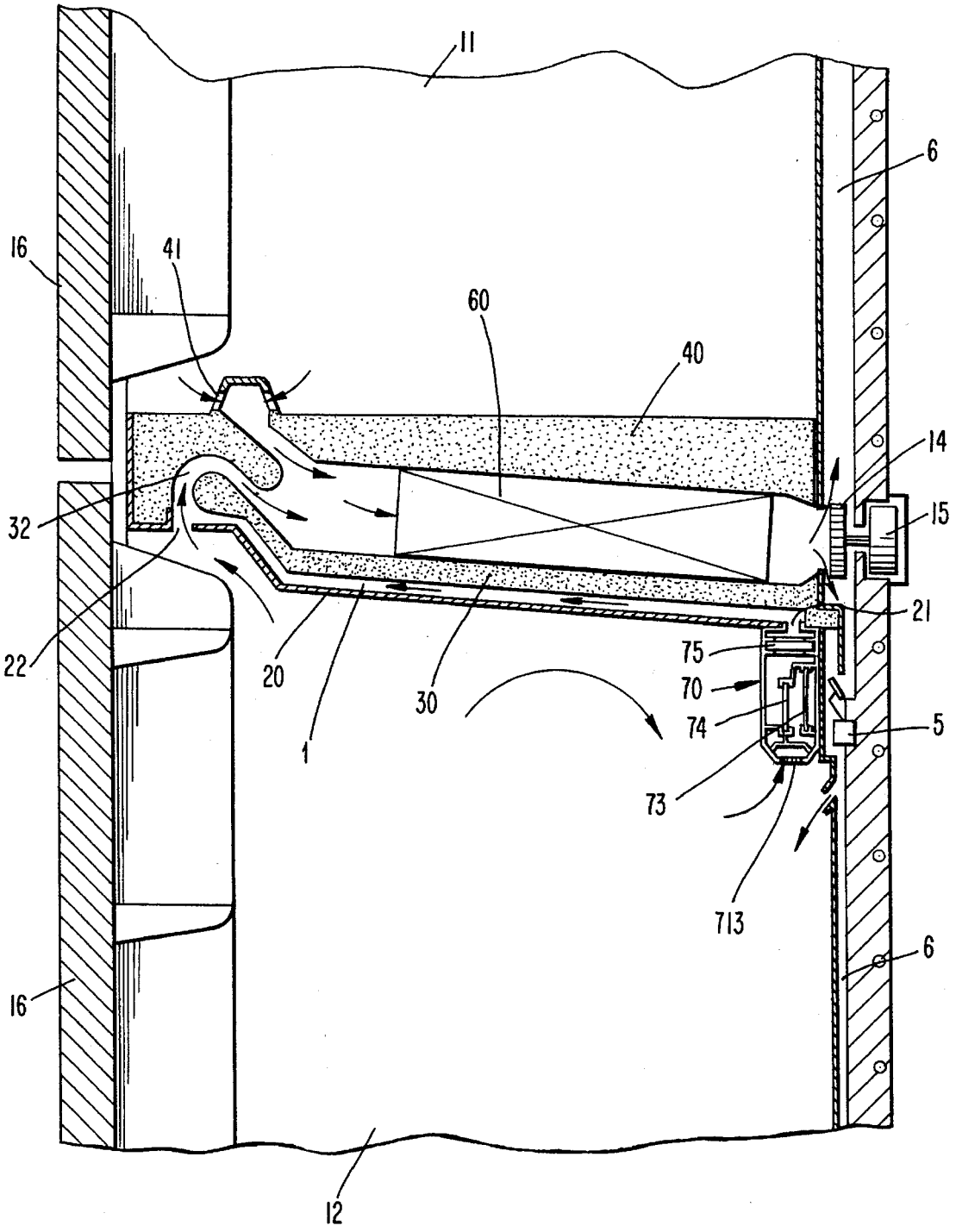
FIG. 5 is a schematic vertical sectional view of a fragment of the refrigerator of the first embodiment.

FIG. 3 is a perspective view showing the refrigerator with the door open, and with a sterilizing and deodoring means of a first embodiment of the present invention installed. FIG. 4 is an exploded perspective view showing the principal components of the first embodiment of the present invention. FIG. 5 is a schematic side sectional view of the refrigerator of the first embodiment with a side cut off.

Referring to FIGS. 3 to 5, reference numeral 10 indicates the main body of the refrigerator forming the outer contour of the refrigerator. The interior of the main body 10 consists of a refrigerating room or chamber 12 for storing foods to be refrigerated, and a freezing room or chamber 11 for storing foods to be frozen. The front of the main body includes doors 16 for closing and opening the refrigerating room 12 and the freezing room 11. Tracks 13 are formed on the approximately upper portion of the main body 10 in which the refrigerating room 12 and freezing room 11 are formed. An upper insulating member 40 and a lower insulating member 30 which are made of a heat insulating material such as urethan are fixedly installed within the tracks 13 for partitioning the refrigerating room 12 from the freezing room 11.

An evaporator 60 is installed in a compartment formed between the upper insulating member 40 and the lower insulating member 30. At the rear of the upper insulating member 40 and the lower insulating member 30, there are installed a fan motor 15 and a fan 14 driven by the fan motor 15 which generates a blowing power, so that cold air which has circulated through the refrigerating room 12 and the freezing room 11 would be supplied to the evaporator 60, so that the cold air chilled by the evaporator 60 would be circulated through the refrigerating room 12 and the freezing room 11.

There are formed entrance holes 32 on the leading end portion of the lower insulating member 30, and there are formed channels 31 on the bottom of the lower insulating member 30, so that the cold air which has circulated through the refrigerating room 12 would be supplied to the evaporator 60. Further, a suction hole 41 is formed on the leading end portion of the upper insulating member 40, so that the cold air which has circulated through the freezing room 11 by the action of the fan 14 would be supplied to the evaporator 60.

Further, an outer contour member 20 is fixedly installed on the lower portion of the lower insulating member 30 for forming the upper outer contour (ceiling) of the refrigerating room 12 and for guiding the flow of the purified cold air, in such a manner that the cold air is should be supplied to the evaporator 60 after passing through a sterilizing and deodoring means (to be described later).

That is, the outer contour member 20 includes: a connecting hole 21 formed on the base portion for introducing the cold air purified by passing through the sterilizing and deodoring means (to be described below); a projecting portion 24 continuously projected for guiding the flow of the purified chill after its introduction through the connecting hole 21; and a suction hole 22 formed on the leading end portion of the projected portion 24 for guiding the chill from the projected portion 24 and the a part of the chill from the refrigerating room 12 into a suction hole 32. Thus the outer contour member 20 not only guides the flow of the chill which has been purified by being passed through the sterilizing and deodoring means (to be described later), but also forms the outer contour of the upper portion of the refrigerating room 12.

Further, the lower insulating member 30 is mounted upon the outer contour member 20, so that the two members would be coupled. Accordingly, a cold air path 1 is formed in such a manner that the cold air should flow through the channels 31 of the lower insulating member 30 and the projecting portion 24 of the outer contour member 20 and should also pass through the suction hole 32 of the lower insulating member 30 to be supplied to the evaporator without leaking.

Meanwhile, in the drawing, reference numeral 70 indicates the sterilizing and deodoring means, and its rear portion is open, while its front portion is provided with a displaying window 711 which shields against ultraviolet rays and through which the user visually confirm the sterilizing and the deodoring action. On the bottom of the means 70, there is formed a suction hole 713 for sucking the cold air after its circulation through the refrigerating room 12. The sterilizing and deodorizing means 70 further includes: a front case 71 provided with a discharge hole 712 to be connected to the connecting hole 21 of the outer contour member 20 for discharging the purified cold air; and a rear case 72 provided with flange portions 721 on both sides for being detachably attached to the refrigerating room 12, with its front face open.

The interior of the sterilizing and deodoring means 70 in which the outer contour is formed by the front case 71 and the rear case 72 includes: a glow discharge lamp 73 for radiating ultraviolet rays of wave length 185 nm and 254 nm to remove the foul odor and to sterilize the floating bacteria; an optically exciting catalyst 74 for removing the foul odor component by decomposing the foul odor component after capturing the foul odor component with the help of the energy radiated from the glow discharge lamp 73; and an ozone decomposing catalyst 75 for reducing the unreacted remaining ozone to oxygen, i.e., the unreacted portion of the ozone formed by the radiated ultraviolet rays of the glow discharge lamp.

When the discharge hole 712 of the sterilizing and deodoring means 70 is to be inserted into the connecting hole 21 of the outer contour member 20, a packing means is installed, so that the cold air purified by the sterilizing and deodoring means 70 would flow through the discharge hole 712 and the connecting hole 21 without leakage so as to be supplied through the cold air path 1 to the evaporator 60.

Meanwhile, according to FIG. 4, the sterilizing and deodoring means 70 sterilizes the floating bacteria and removes the foul odor by means of the optically exciting catalyst 74 and the ozone decomposing catalyst 75. However, the present invention is not limited to this, but further the sterilizing and deodoring means of the present invention sterilizes the floating bacteria and removes the foul odor without resorting an extra fan and a fan motor.

In the drawings, reference numeral 5 indicates a thermostat for controlling the temperature of the refrigerating room 12, and 6 indicates a guide duct for supplying the cold air into the refrigerating room 12 and the freezing room 11 after the cold air has been chilled by the evaporator 60. The first embodiment of the present invention constituted as above will now be described as to its operation and effect.

When the refrigerator operates, the power source is supplied to the fan motor 15 to drive it, and then, the fan 14 is rotated by the fan motor 15.

When the fan 14 revolves, the cold air which is chilled by the evaporator 60 is guided by the duct 6 to be supplied to the refrigerating room 12 and to the freezing room 11. The cool air thus supplied into the rooms 12 and 11 circulates in the direction of the arrows of FIG. 5.

A part of the cool air which has circulated through the refrigerating room 12 is introduced into the sterilizing and deodoring means 70 by the help of the fan 14, while the rest of the cool air flows into the suction hole 22 of the outer contour member 20.

The cool air which has entered into the sterilizing and deodoring means 70 by the help of the fan 14 has its odor particles removed by the optically exciting catalyst 72 of the sterilizing and deodoring means 70. Further, the foul odor is gradually removed by ultraviolet rays radiated from the glow discharge lamp 73 and having a wave length of 185 nm and 254 nm, as well as sterilizing the floating bacteria.

Further, the ozone which is produced by the ultraviolet rays radiated by the glow discharge lamp 73 and having a wave length of 185 nm leaves an unreacted portion. This unreacted ozone is reduced to oxygen by the ozone decomposing catalyst 75.

The cool air which has passed through the ozone decomposing catalyst 75 turns into a purified cool air, and passes through the discharge hole 712 of the front case 71 to be supplied into the connecting hole 21 of the outer contour member 20.

Under this condition, the cool air which has circulated through the refrigerating room 12 is supplied into the sterilizing and deodoring means 70, and therefore, there is no apprehension that frost and the like can be accumulated within the sterilizing and deodoring means, with the result that the floating bacteria and the odor particles can be effectively removed.

The purified cool air which is supplied to the connecting hole 21 of the outer contour member 20 is sucked by the fan 14 to make the cool air flow into the cool air path 1 formed by the projected portion 24 of the outer contour member 20 and the channels 31 of the lower insulating member 30.

Further, the purified cool air which is guided by the cool air path 1 passes through the suction hole 32 of the lower insulating member 30 as shown in FIG. 5 to be supplied to the evaporator 60. The purified cool air which is supplied to the evaporator 60 is deprived of heat, with the result that the air flow is turned into a cold purified air flow.

The cold and purified air flow is guided by the fan 14 to be supplied into the refrigerating room 12 and the freezing room 11.

Consequently the floating bacteria are sterilized, and the foul odor is removed in both the refrigerating room 12 and the freezing room 11. Therefore, foods can be stored both in the refrigerating room 12 and the freezing room 11 in a fresh state.

Further, a separate fan and a separate fan motor are not required within the sterilizing and deodoring means, and therefore, no extra heat is generated which would be transmitted into the refrigerating room 12, etc. As a result, not only the refrigerating efficiency is improved, but also the noise and vibration are reduced, thereby improving the quality of refrigerator.

Now a second embodiment of the present invention will be described referring to FIG. 6.

Figure 6:
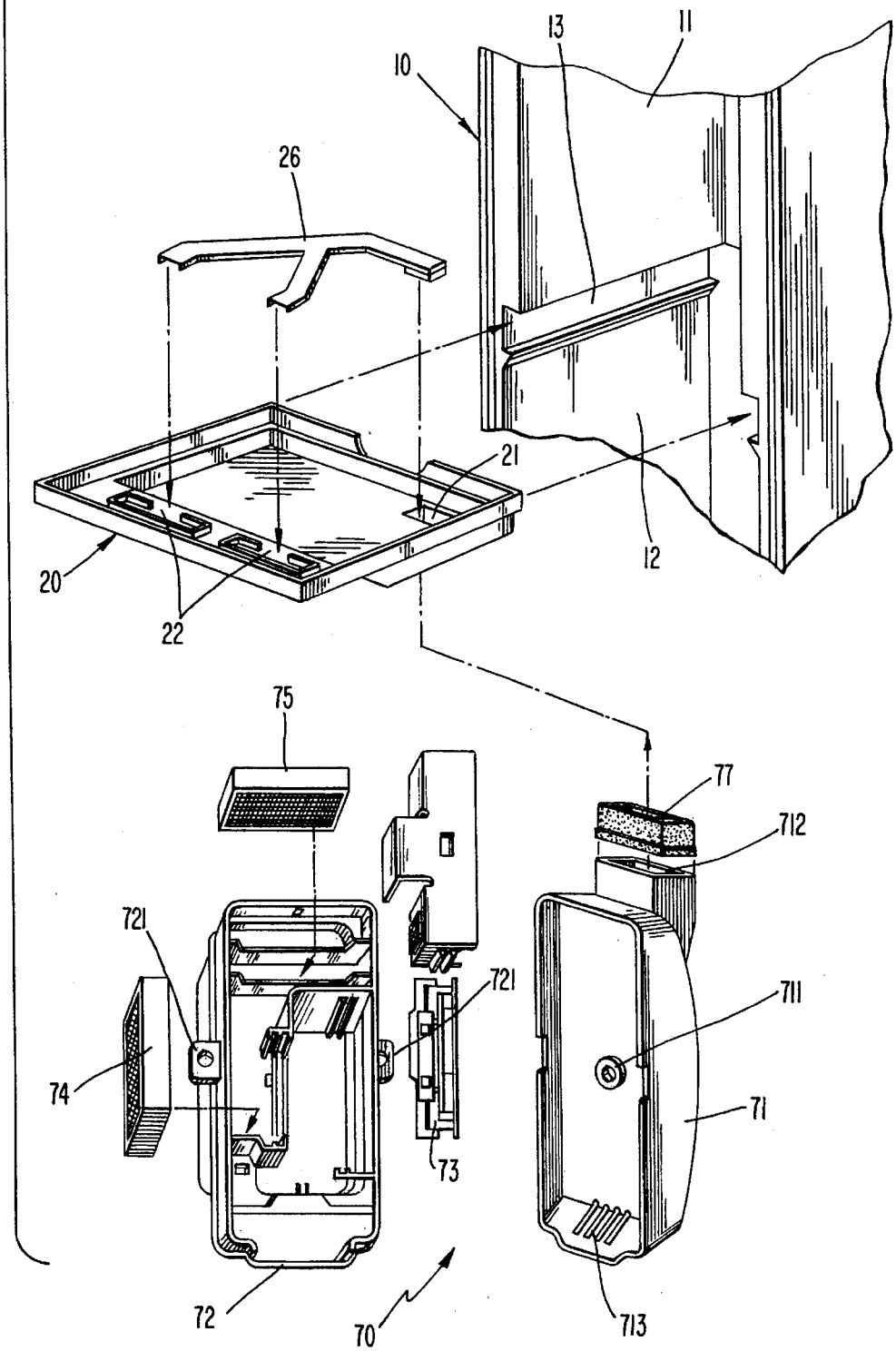
FIG. 6 is an exploded perspective view showing the principal components of a second embodiment of a sterilizer and deodorizer of the present invention.

FIG. 6 is an exploded perspective view showing the principal components of the second embodiment of the present invention. The difference between the first and second embodiments is that a chill guide member 26 is attached to the outer contour member 20 for guiding the flow of the chill instead of previously described, projected portion 24, so that the purified cool air which has passed through the sterilizing and deodoring means 70 would be guided by the guiding member 26 to be supplied to the evaporator 60.

Now a third embodiment of the present invention will be described referring to FIG. 7.

Figure 7:
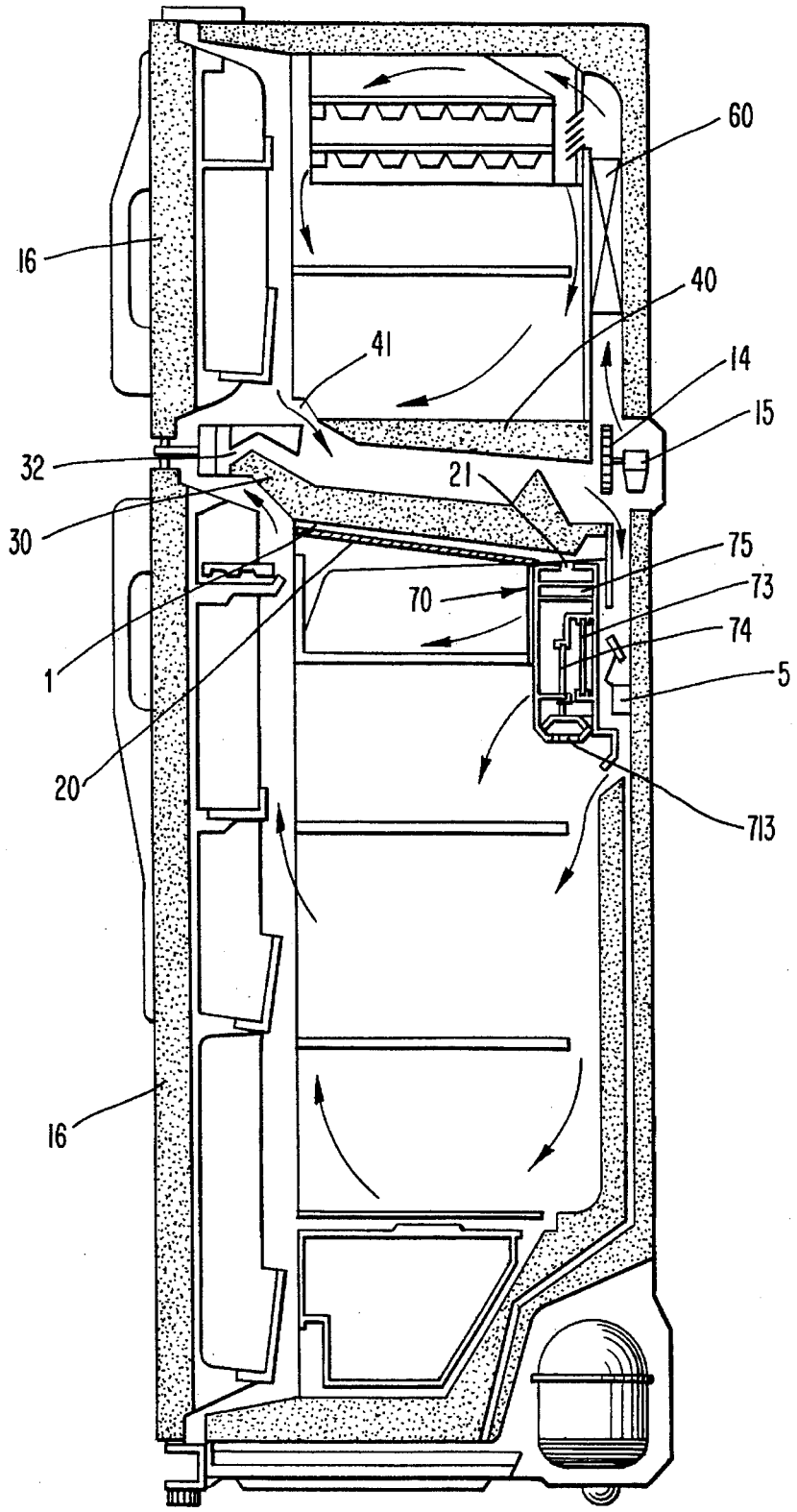
FIG. 7 is a schematic vertical sectional view through a refrigerator showing a third embodiment of the present invention.

FIG. 7 is a schematic side sectional view showing a third embodiment of the present invention with a side cut off. The difference between this third embodiment and the first and second embodiments is that the sterilizing and deodoring means 70 is installed on an upstanding type refrigerator in which the evaporator 60 is installed on the back of the freezing room 11. That is, the device of the present invention can be applied to all types of refrigerators. According to the present invention as described above, the chill circulates within the refrigerator by passing through a sterilizing and deodoring means which does not require a separate fan and a separate fan motor. Therefore, the floating bacteria can be effectively sterilized, and the foul odor can be effectively removed. The lack of a fan and a fan motor within the sterilizing and deodoring means improves the refrigerating efficiency, and therefore, the quality of refrigerator is improved.

What is claimed is:

1. A refrigerator comprising:

a main body forming a freezing chamber and a refrigerating chamber;

a compartment disposed above said refrigerating chamber;

an evaporator disposed in said compartment for cooling air;

a first air inlet path leading from said refrigerating chamber to said evaporator;

a second air inlet path leading from said freezing chamber to said evaporator;

a first air outlet path leading from said evaporator to said refrigerating chamber;

a second air outlet path leading from said evaporator to said freezing chamber;

a fan disposed in said main body for circulating air to said evaporator from said refrigerating and freezing chambers, then through said first and second air inlet paths, and then back to said refrigerating and freezing chambers from said evaporator through said first and second air outlet paths, respectively; and an air sterilizing and deodorizing mechanism disposed in said first air inlet path upstream of said evaporator for sterilizing floating bacteria and removing foul odor from air traveling from said refrigerating chamber toward said evaporator;

a contour plate underlying said compartment and forming a ceiling of said refrigerating chamber;

a thermal insulation member overlying said contour plate; and a section of said first air inlet path being formed between said contour plate and said thermal insulation member.

2. The refrigerator according to claim 1, wherein said air sterilizing and deodorizing mechanism is disposed at an upstream end of said section of said first air inlet path.

3. The refrigerator according to claim 2, further including a housing disposed at said upstream end and forming a portion of said first air inlet path; said air sterilizing and deodorizing mechanism disposed within said housing.

4. The refrigerator according to claim 3, wherein said fan is situated downstream of said evaporator.

5. The refrigerator according to claim 1, wherein said air sterilizing and deodorizing mechanism is disposed on a bottom side of said contour plate and communicates with said section of said first inlet path through a hole formed in said contour plate.

6. The refrigerator according to claim 5, wherein said sterilizing and deodorizing mechanism includes a case having an inlet communicating with said refrigerating chamber and an outlet communicating with said hole, a glow discharge lamp disposed in said case for radiating ultraviolet rays to remove foul odor and sterilize air passing trough said case, a first catalyst in said case for being activated by radiant energy from said lamp for decomposing foul odor in the air, and a second catalyst in said case for decomposing ozone formed by radiated ultraviolet rays of said lamp.

7. The refrigerator according to claim 1, wherein said compartment is disposed in a partition separating said freezer and refrigerating compartments.

8. The refrigerator according to claim 1, wherein said thermal insulation member constitutes a first thermal insulation member, there being provided a second thermal insulation member spaced above said first thermal insulation member to form said compartment therebetween.

* * * * *